US007015402B2

(12) United States Patent
Bianco

(10) Patent No.: US 7,015,402 B2
(45) Date of Patent: Mar. 21, 2006

(54) CODING SWITCH

(75) Inventor: Lucio Bianco, Jona (CH)

(73) Assignee: ELMA Electronic AG, Wetzikon (CH)

( * ) Notice: Subject to any disclaimer, the term of this patent is extended or adjusted under 35 U.S.C. 154(b) by 67 days.

(21) Appl. No.: 10/882,880

(22) Filed: Jun. 30, 2004

(65) Prior Publication Data

US 2005/0023114 A1 Feb. 3, 2005

(30) Foreign Application Priority Data

Jul. 29, 2003 (EP) ..... 03405566

(51) Int. Cl.
*H01H 19/10* (2006.01)

(52) U.S. Cl. ..... 200/11 DA; 200/292

(58) Field of Classification Search . 200/11 R–11 TW, 200/564, 570, 571, 292, 336
See application file for complete search history.

(56) References Cited

U.S. PATENT DOCUMENTS 3,651,287 A 3/1972 Rubenstein
3,736,390 A * 5/1973 Lockard ..... 200/11 DA
3,961,145 A 6/1976 Halbeck
4,081,898 A * 4/1978 Taylor et al. ..... 29/622
4,145,585 A * 3/1979 Iwasaki ..... 200/11 DA
4,218,593 A * 8/1980 Mayer et al. ..... 200/11 TW
4,737,608 A 4/1988 Jones
5,017,741 A * 5/1991 Brown et al. ..... 174/260
5,422,448 A * 6/1995 Nakano et al. ..... 200/11 DA
5,695,048 A * 12/1997 Tseng ..... 200/571
6,064,011 A * 5/2000 Amonett ..... 200/11 DA
2002/0125113 A1 9/2002 Bhakta et al.

FOREIGN PATENT DOCUMENTS

DE 19813323 C1 9/1999
EP 0533052 A1 3/1993

* cited by examiner

*Primary Examiner*—Michael A. Friedhofer
(74) *Attorney, Agent, or Firm*—Townsend and Townsend and Crew LLP

(57) ABSTRACT

A rotor (1) for a coding switch is provided with conductive tracks (7) which are designed on a surface of the rotor (1) in such a way that the conductive tracks determine a desired coding, wherein the conductive tracks include one more conducting layers which are subsequently applied to the already formed rotor (1).

13 Claims, 2 Drawing Sheets

CODING SWITCH

BACKGROUND OF THE INVENTION

The invention relates to a rotor for a coding switch, to a coding switch with a rotor of this kind, and to a method for the manufacture of a rotor of this kind.

A typical embodiment of a conventional coding switch includes a mechanical coding disc with depressions and/or elevations which is rotatably fixed and a contact arrangement with opening and/or closing contacts which are operated by the depressions or elevations on the coding disc. The contacts corresponding to the desired coding are established according to the rotational angle of the coding disc. A coding switch of this kind is described in U.S. Pat. No. 4,822,960. The described coding switch has the disadvantage that its manufacture is comparatively complicated since, in general, two shaped parts are required for the contacts. It is also a disadvantage that the opening and closing of the contacts takes place by means of deflection of a flexible contact element, which inevitably involves chattering of the contacts.

SUMMARY OF THE INVENTION

It is an object of the invention to make available a rotor for a coding switch and a coding switch with a rotor of this kind, which makes possible an economical manufacture of the coding switch from a small number of parts. The characteristics of the rotor should additionally contribute to the reduction of the contact chatter when compared with the prior art. A further object of the invention is to make available a method for the manufacture of a rotor of this kind.

The rotor of the present invention has one or more conductive tracks, which are formed in such a way on the surface of the rotor that the conductive tracks determine a desired coding, for example a binary 8-4-2-1 coding. In addition the conductive tracks are subsequently applied to the already formed rotor. The conductive tracks preferably include one or more conductive layers or foils, in particular a copper foil. The surface of the conductive tracks is preferably substantially flush with the surface of the already formed rotor.

In a preferred embodiment the conductive tracks include a metal foil applied according to a hot foil stamping process, in particular a copper foil.

In a further preferred embodiment at least two mechanical stops are provided on the rotor. The at least two mechanical stops are preferably arranged on the rotor offset in the axial direction. A rotor with at least two mechanical stops or a coding switch with a rotor of this kind can also be seen as an independent subject, which could be protected in a separate application.

The invention further includes a coding switch with a rotor made in accordance with the above description and with contact elements, preferably contact springs, in order to contact the conductive tracks applied to the rotor.

In a preferred embodiment the coding switch additionally includes a index spring on which two indexing elements are formed. The index spring is preferably formed in one piece with the indexing elements. The index spring can preferably be inserted into the rotor. The two indexing elements preferably lie diametrically opposite one another with respect to the rotor. The index spring used in the present coding switch can also be seen as an independent subject matter which could be protected in a separate application.

The invention further includes a method for the manufacture of a rotor for a coding switch in which first a rotor or a part of a rotor is formed and subsequently conductive tracks are applied to a surface of the formed rotor or rotor part which determine a desired coding. The conductive tracks are preferably applied by means of a hot foil stamping process.

The rotor of the invention has the advantage that it can be manufactured at a comparatively favorable price, for example by initially manufacturing an injection molded part corresponding to the shape of the rotor and then applying conductive tracks to a surface of the injection molded part. Economical mass-production methods are available for both operational steps. This kind of rotor manufacture is also flexible, since one new form tool for the conductive tracks is generally enough for an alteration of the coding. It is further to advantage that a coding switch with a rotor of this kind can be manufactured economically since in addition to the rotor only a housing, a contact plane with contact elements and a index spring are required to complete the coding switch. Due to the small number of parts, the assembly of the coding switch can be carried out simply and economically.

If the conductive tracks are applied to the rotor by means of a hot foil stamping process for example, then the surfaces of the conductive tracks are substantially flush with the surface of the rotor. As a result, when a rotor is rotated the contact elements experience practically no deflection so that the contact chattering is slight. In one embodiment at least two stops are provided on the rotor, which means that a higher stop moment can be achieved which is particularly important in the case of very small coding switches.

The invention will be explained in more detail with the help of the embodiments and with the help of the drawings.

DESCRIPTION OF THE PREFERRED EMBODIMENTS

Figure 1:
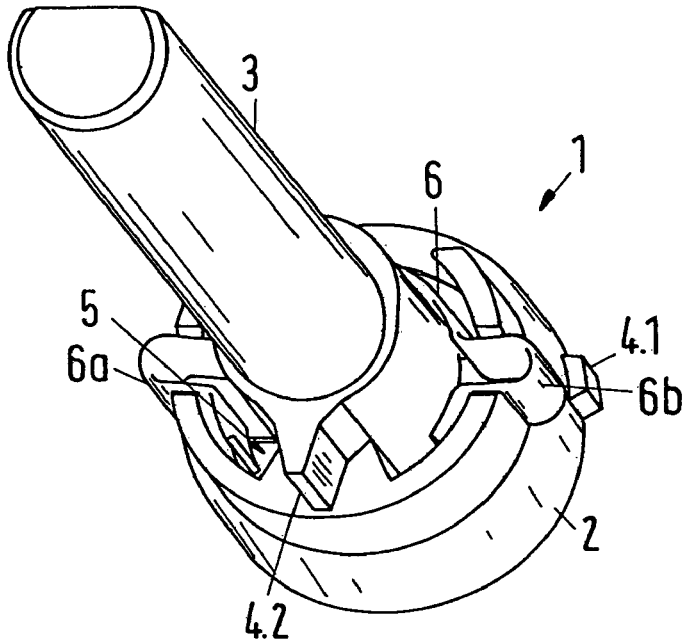
FIG. 1 is a perspective view of an embodiment of a rotor in accordance with the present invention.
Figure 2:
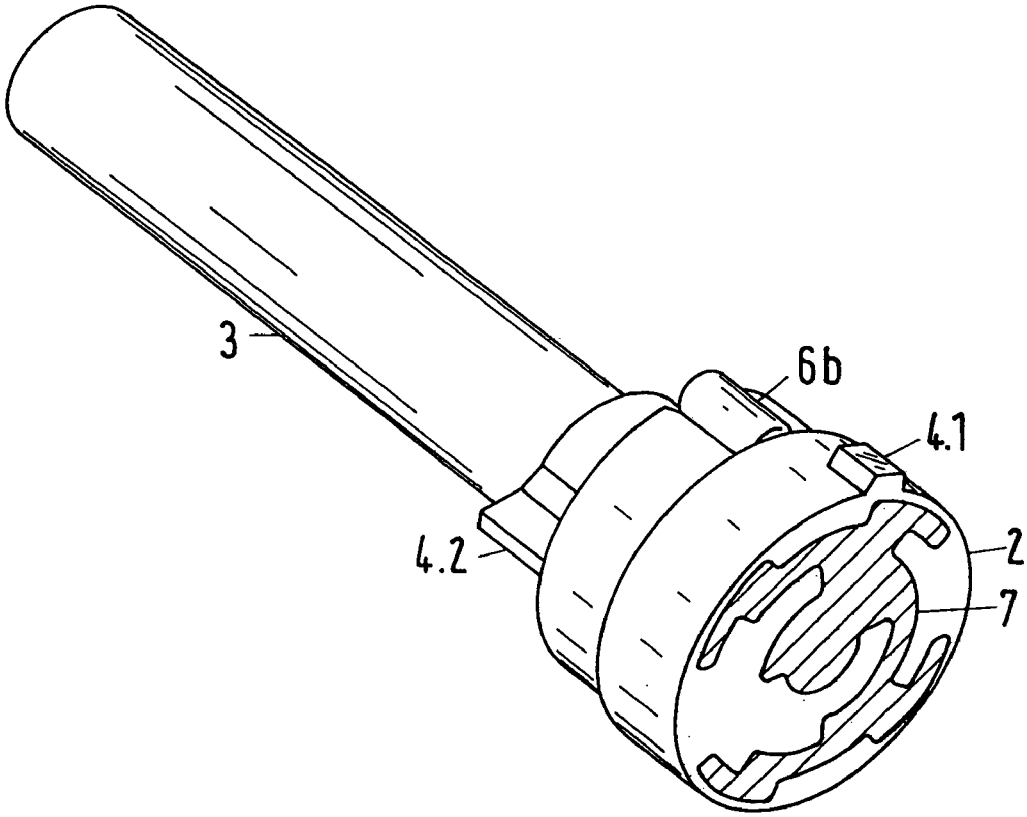
FIG. 2 is a further perspective view of the same embodiment.

FIG. 1 and FIG. 2 show two different perspective views of an embodiment of a rotor in accordance with the present invention. The rotor 1 includes in the embodiment a rotor part 2, which is formed for example in a cylinder shape. The rotor part 2 is provided with one or more conductive tracks 7 which are shaped in such a way that, in combination with correspondingly arranged electrical contact elements, they determine a desired coding, for example a binary 8-4-2-1 coding or a BCD coding derived from this, wherein the conductive tracks are subsequently applied to the already formed rotor 1 or the already formed rotor part 2. The conductive tracks 7 include one or more conductive layers or foils, preferably a metal foil, such as for example a copper foil. The surface of the conductive tracks is expediently flush with the surface of the already formed rotor or rotor part. In a preferred embodiment the conductive tracks 7 include a metal foil applied by the hot foil stamping process, preferably a copper foil.

In the embodiment the conductive tracks 7 are applied to the circular surface of the cylindrical rotor part 2. It goes without saying that the conductive tracks can be applied to any flat surface of the rotor 1 or rotor part 2 which is perpendicular to the rotor axis. An arrangement of the conductive tracks on a jacket surface is also possible.

In a further embodiment the rotor part 2 is connected to a device for rotating the rotor part 2. This device is designed as a rotational axle 3 in the embodiment. It is however also possible to provide the rotor part 2 with a slit so that the rotor part 2 can be rotated with a tool.

In a preferred embodiment there are at least two mechanical stops 4.1, 4.2 formed at the rotor 1 and/or at the rotor part 2, in order to cooperate with correspondingly arranged stops in a housing or housing part of the coding switch. By distributing the stop moment to a plurality of stops a higher stop moment can be achieved, which is particularly important for very small coding switches. In a further preferred embodiment the stops 4.1, 4.2 are arranged on the rotor 1 and/or the rotor part 2 offset in the axial direction.

Figure 3:
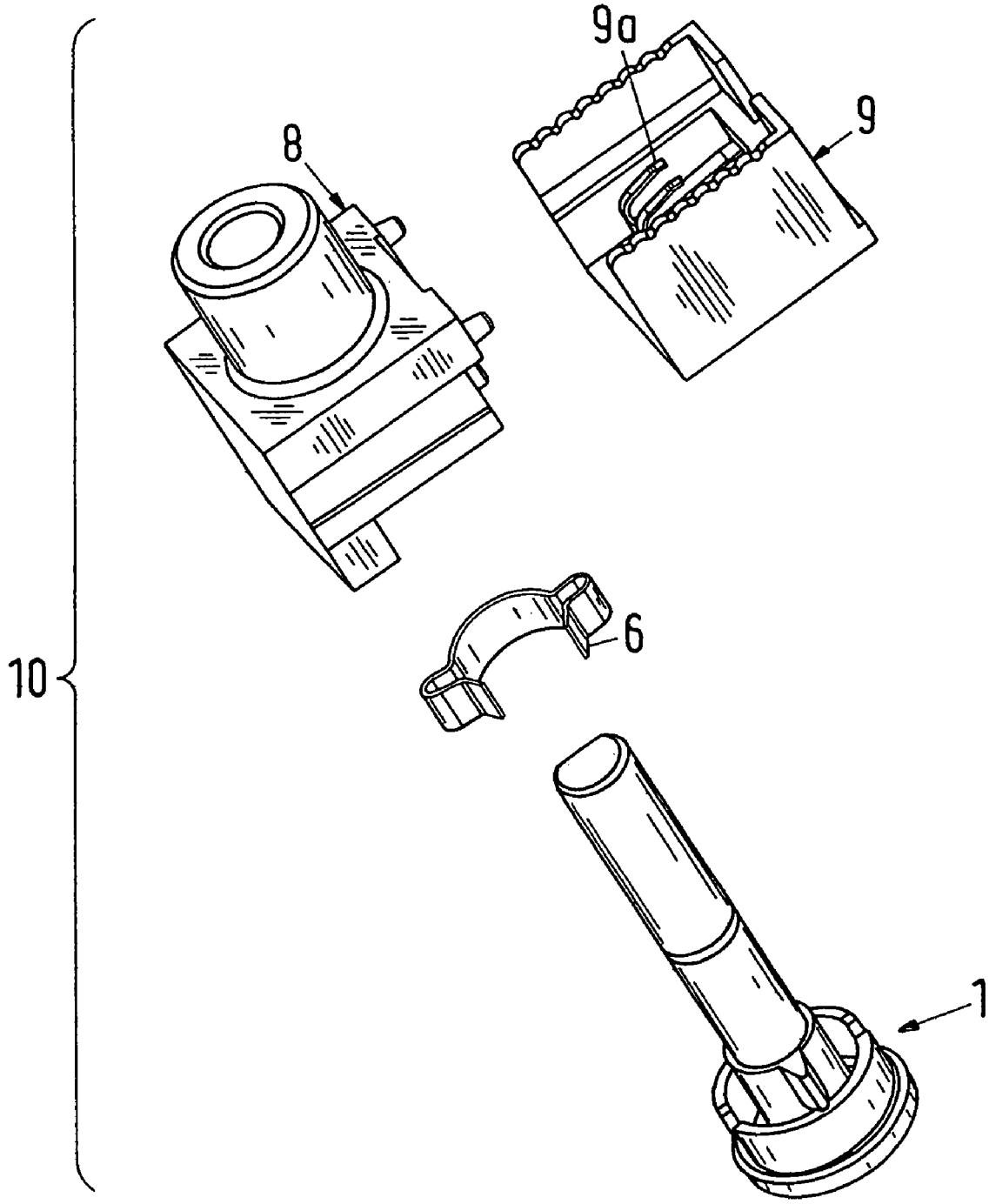
FIG. 3 is an exploded drawing of an embodiment of a coding switch in accordance with the present invention.

In the embodiment of a coding switch in accordance with the invention shown in FIG. 3, the coding switch 10 includes a rotor 1, preferably a rotor as described in one of the previous sections, a first housing part 8, a second housing part 9 with contact elements 9*a*, which can be designed as spring contacts for example, and a index spring 6. The rotor 1 and/or the rotor part 2 advantageously have a cut-out 5 (see FIG. 1) into which the index spring 6 can be inserted. On assembly of the coding switch 10, the rotor 1 is inserted into the first housing part 8 with the index spring 6 and the two housing parts 8 and 9 are subsequently connected to one another, for example by being pushed into one another, with the housing parts being provided with corresponding connecting elements. Since only a few parts are present, assembly is simple and economical. If required, the assembly can be automated.

In a preferred embodiment the index spring 6 includes two indexing elements 6*a*, 6*b* (see FIGS. 1 and 2) in order to cooperate with corresponding recesses in one of the housing parts 8, 9 of the coding switch 10. The index spring is preferably formed in one piece with the indexing elements 6*a*, 6*b*. The index spring 6 is preferably formed from a spring band, for example from spring-steel band. The spring band of the index spring inserted into the coding switch is preferably arranged substantially parallel to the rotary axis. Due to the parallel arrangement of the spring band relative to the rotor axis, high latch moments can be achieved. The two indexing elements 6*a*, 6*b* of the index springs inserted into the coding switches advantageously lie diametrically opposite to one another with respect to the rotary axis. The indexing elements lying opposite one another prevent a one-sided loading of the rotor mounting.

In a preferred embodiment of a method for the manufacture of a rotor for a coding switch in accordance with the present invention, a rotor 1 or a rotor part 2 is formed initially, for example as an injection molded part which can, for example, be made of plastic. Subsequently, in a further step, conductive tracks are applied to a surface of the formed rotor 1 or the rotor part 2, which determine a desired coding, for example a binary 8-4-2-1 coding or a BCD coding derived from this. In a preferred embodiment the formed rotor 1 is made in one piece together with any further parts such as for example a rotary axle 3 or stops 4.1, 4.2.

In a preferred embodiment the conductive tracks 7 are applied by means of a hot foil stamping process. In a hot foil stamping process of this kind the contours of the conductive tracks 7 are, for example, stamped out of a metal foil, for example out of a copper foil of suitable thickness which is preferably between 12 and 100 $\mu$m and typically 35 $\mu$m, and the stamped-out conductive tracks are applied with a heated stamp onto the rotor 1 or the rotor part 2, for example by pressing the conductive tracks by means of the heated stamp onto the rotor 1 or the rotor part 2. The same stamp is preferably used for stamping out and applying the conductive tracks. For the application of the conductive paths 7 onto the rotor 1 or the rotor part 2 a treatment layer is additionally provided, for example a treatment layer which includes a roughened and/or oxidized surface layer in order to guarantee a good adhesion onto plastic. In one embodiment the treatment layer includes an adhesive which can be activated by means of heat, for example a melt adhesive and/or a hot curing adhesive. The treatment layer is advantageously provided on the reverse side of the metal foil which is used or of the conductive tracks 7. The conductive tracks are advantageously pushed onto the surface of the rotor 1, or of the rotor part 2, in such a way that the surface of the conductive tracks 7 is substantially flush with the surface of the rotor 1, or of the rotor part 2.

The above-described rotor in accordance with the present invention has the advantage that it can be manufactured comparatively economically, since only two method steps are required for the manufacture, the manufacture of the formed rotor part and the application of the conductive tracks. As has been described above, suitable mass production methods are available for both method steps. It is particularly advantageous that a coding switch with a rotor of this kind can be manufactured economically, since apart from the rotor only a few additional parts are necessary. The coding switch of the embodiment described above only comprises four parts which can be assembled simply.

The invention claimed is:

1. A rotor for a coding switch, the rotor comprising a surface, and at least one conductive track, which determines a desired coding, the at least one conductive track having an exposed surface which is substantially flush with the rotor surface.

2. A rotor in accordance with claim 1, wherein the at least one conductive track comprises a copper foil adhered to the surface of the rotor.

3. A rotor in accordance with claim 1, wherein the at least one conductive track comprises a metal foil pushed onto the surface of the rotor by a hot foil stamping process.

4. A rotor in accordance with claim 1, wherein at least two mechanical stops are provided on the rotor.

5. A rotor in accordance with claim 4, wherein the at least two mechanical stops are arranged on the rotor offset in the axial direction.

6. A coding switch comprising a rotor including a surface, at least one conductive track, which determines a desired coding for the switch, the at least one conductive track having an exposed surface which is substantially flush with the rotor surface, and contact elements for contacting the at least one conductive track.

7. A coding switch in accordance with claim 6, wherein the coding switch includes a one-piece index spring having at least two indexing elements.

8. A coding switch in accordance with claim 6, wherein the index spring is adapted to be inserted into the rotor.

9. A coding switch according to claim 8 wherein the at least two indexing elements lie diametrically opposite one another with respect to the rotor.

10. A coding switch according to claim 6 wherein the contact elements comprise contact springs.

11. A method for the manufacture of a rotor for a coding switch comprising initially providing a rotor, forming conductive tracks which define a desired coding when applied to a surface of the rotor, and thereafter applying the conductive tracks to the surface by hot foil stamping the conductive tracks onto the surface so that exposed surfaces of the conductive tracks are substantially flush with the surface.

12. A method according to claim 11 wherein applying comprises pushing the at least one conductive track onto the surface of the rotor.

13. A method for the manufacture of a rotor for a coding switch comprising producing a rotor made of a plastic material, the rotor having a surface, forming at least one conductive track which defines a desired coding when applied to the surface, and applying the at least one conductive track to the surface of the rotor by pushing the at least one conductive track at an elevated temperature onto the surface so that an exposed surface of the at least one conductive track is substantially flush with the surface of the rotor.

* * * * *